US009345956B2

(12) United States Patent
MacDonald et al.

(10) Patent No.: US 9,345,956 B2
(45) Date of Patent: May 24, 2016

(54) RANDOMIZER UNIT FOR SIMULATING GAME PLAY

(71) Applicant: Las Vegas Sands Corp., Las Vegas, NV (US)

(72) Inventors: Andrew MacDonald, Singapore (SG); Kelvin Morin, Las Vegas, NV (US); Wayne Stevens, Chonburi (TH)

(73) Assignee: Las Vegas Sands Corp, Las Vegas, NV (US)

( * ) Notice: Subject to any disclaimer, the term of this patent is extended or adjusted under 35 U.S.C. 154(b) by 48 days.

(21) Appl. No.: 13/944,748

(22) Filed: Jul. 17, 2013

(65) Prior Publication Data

US 2014/0319769 A1 Oct. 30, 2014

Related U.S. Application Data

(60) Provisional application No. 61/816,058, filed on Apr. 25, 2013.

(51) Int. Cl.

| | |
|---|---|
| ***A63B 71/00*** | (2006.01) |
| ***A63F 11/00*** | (2006.01) |
| ***G07F 17/32*** | (2006.01) |
| ***A63F 7/04*** | (2006.01) |
| ***A63F 9/04*** | (2006.01) |
| *A63F 9/24* | (2006.01) |

(52) U.S. Cl.

CPC ..... *A63F 11/0011* (2013.01); *A63F 7/048* (2013.01); *A63F 9/0406* (2013.01); *G07F 17/3202* (2013.01); *A63F 9/0415* (2013.01); *A63F 2009/2482* (2013.01)

(58) Field of Classification Search

CPC ..... A63F 5/00; A63F 5/0088
USPC ..... 273/142 E
See application file for complete search history.

(56) References Cited

U.S. PATENT DOCUMENTS

| | | | | |
|---|---|---|---|---|
| 470,498 | A * | 3/1892 | Mader | 273/145 D |
| 1,708,472 | A * | 4/1929 | Fulgora | 273/142 H |
| 2,831,692 | A * | 4/1958 | Keast | 273/145 E |
| 3,608,905 | A * | 9/1971 | Edison | 273/146 |
| 4,890,845 | A * | 1/1990 | Gatewood | 273/271 |
| 4,907,804 | A * | 3/1990 | Arad et al. | 273/244.1 |
| 5,102,138 | A * | 4/1992 | Johnson | 273/144 B |
| 5,197,735 | A * | 3/1993 | Land et al. | 273/144 R |
| 5,531,318 | A * | 7/1996 | Coleman et al. | 206/738 |
| 6,520,854 | B1 * | 2/2003 | McNally | 463/17 |
| 6,584,986 | B2 * | 7/2003 | Gindi | 132/293 |
| 6,588,435 | B1 * | 7/2003 | Gindi | 132/293 |
| 6,596,351 | B1 * | 7/2003 | Thompson | 428/7 |
| 7,780,166 | B1 * | 8/2010 | Paxton et al. | 273/145 C |
| 8,079,593 | B2 * | 12/2011 | Nicely et al. | 273/145 CA |
| 8,215,640 | B2 * | 7/2012 | Sasaki | 273/145 D |

(Continued)

*Primary Examiner* — Michael Dennis
*Assistant Examiner* — Dolores Collins
(74) *Attorney, Agent, or Firm* — McDermott Will & Emery LLP

(57) ABSTRACT

A device and method is provided for simulating an outcome of a game, the device including a die having a plurality of faces, each face of the die being associated with an index value, a first wheel having a surface for rolling of the die, and a randomization mechanism coupled to the wheel and configured to cause a randomized motion of the wheel and die for a period of time to generate an outcome of game play, the outcome of game play being defined at least in part based on the index value of an exposed face of the plurality of faces of the die after the completion of the randomized motion.

16 Claims, 14 Drawing Sheets

(56) References Cited

U.S. PATENT DOCUMENTS

| | | | | |
|---|---|---|---|---|
| 8,376,362 | B2 * | 2/2013 | Nicely et al. | 273/145 CA |
| 8,449,372 | B2 * | 5/2013 | Glenn et al. | 463/17 |
| 8,622,391 | B2 * | 1/2014 | Nicely et al. | 273/145 CA |
| 2004/0074513 | A1 * | 4/2004 | Glndi | 132/293 |
| 2006/0017225 | A1 | 1/2006 | Nicely | |
| 2007/0029726 | A1 | 2/2007 | Ohira | |
| 2008/0096642 | A1 * | 4/2008 | Yoshizawa | 463/22 |
| 2009/0134574 | A1 * | 5/2009 | Sokolov | 273/142 R |
| 2009/0224475 | A1 * | 9/2009 | Hsu et al. | 273/146 |
| 2014/0203504 | A1 * | 7/2014 | MacDonald | 273/142 E |

* cited by examiner

RANDOMIZER UNIT FOR SIMULATING GAME PLAY

CROSS-REFERENCE TO RELATED APPLICATION

The present application claims the benefit of U.S. Provisional Patent Application Ser. No. 61/816,058, entitled "GAMEBALL APPARATUS," filed on Apr. 25, 2013, which is hereby incorporated by reference in its entirety for all purposes.

BACKGROUND

The outcomes of various games, including for example, various casino games, may be decided according to one or more variables. The outcome of a game may be decided, in some examples, based on various values. To provide randomization of such values, and thus the outcome of a game, in some instances various tools may be used to generate one or more randomized values that are used in the game. Such tools may include cards, wheels, dice, tiles, blocks, etc. In one example, in casino games, the outcome of a game is decided based on a value associated with one or more hands made up of one or more cards, each having one or more values including for example a suit, a color, a numeric value and/or other similar value indicators. In another example, the outcome of the game may be based on values indicated by a wheel, such as a color, character and/or numeric value. Similarly tiles or blocks having different characters, colors or other value indicators may be used in various games to generate a game outcome.

SUMMARY

The disclosed subject matter relates to a device for simulating an outcome of a game, the device including a die having a plurality of faces, each face of the die being associated with an index value, a first wheel having a surface for rolling of the die and a randomization mechanism coupled to the wheel and configured to cause a randomized motion of the wheel and die for a period of time to generate an outcome of game play, the outcome of game play being defined at least in part based on the index value of an exposed face of the plurality of faces of the die after the completion of the randomized motion.

The disclosed subject matter also relates to an apparatus for simulating game play, the apparatus comprising an outcome simulation component for simulating an outcome of game play, the simulation component comprising one or more randomizer units, each randomizer unit comprising a die having a plurality of faces, each face of the die being associated with an index value, a first wheel having a surface for rolling of the die, and a randomization mechanism coupled to the wheel and configured to cause a randomized motion of the wheel and die for a period of time to generate an outcome of game play, the outcome of game play being defined at least in part based on the index value of an exposed face of the plurality of faces of the die after the completion of the randomized motion.

The disclosed subject matter also relates to a device for simulating an outcome of a game having a die, the die having a plurality of faces, each face of the die being associated with an index value, the device comprising a first wheel having a surface for rolling of a die and a randomization mechanism coupled to the wheel and configured to cause a randomized motion of the wheel and die for a period of time to generate an outcome of game play, the outcome of game play being defined at least in part based on the index value of an exposed face of the plurality of faces of the die after the completion of the randomized motion.

The disclosed subject matter also relates to a method for facilitating simulation of game play, the method comprising receiving an indication to initiate a spin, the spin comprising a randomization movement of one or more randomizer units to generate an outcome of a game, each randomizer unit comprising a die and wheel, and a randomization mechanism for causing a randomized movement of the randomizer unit by randomized movement of one or more of the wheel and die. The method further comprising initiating the spin to generate an outcome of game play. The method further comprising receiving an indication to terminate the spin. The method further comprising determining an outcome of game play according to one or more of the position of the die and wheel after the spin is completed and providing the game outcome.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1A:
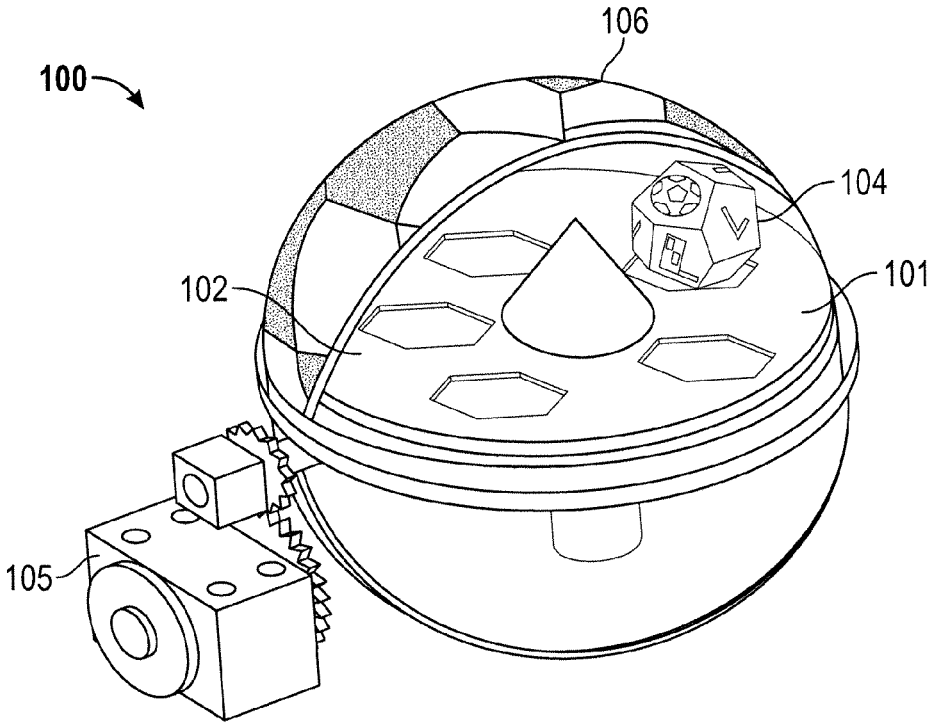
FIGS. 1A and 1B illustrate an example randomizer unit for use within an apparatus for facilitating play of a game.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides a game apparatus that is configured to facilitate play of a game. In one example, the apparatus includes one or more randomizer units ("game balls"), and a game outcome is determined according to a comparison and/or combination of the individual outcome of one or more randomizer units of the apparatus. The game apparatus facilitates play for one or more players, where players can wager on the outcome of a game generated by the one or more randomizer units.

In one implementation, each randomizer unit includes a wheel. In some examples, the wheel is divided into one or more compartments representing distinct "elements". Each compartment may have one or more unique visual characteristics (e.g., color) and/or labels (e.g., alphanumeric characters, symbols, etc.). In on example, the one or more visual characteristics and/or labels of each compartment, either alone or in combination, may represent an "element" having a value that defines at least part of the outcome of the randomizer unit. In addition, the randomizer unit may include at least one die having a plurality of faces. Each face of the die may have one or more unique visual characteristics (e.g., color) and/or labels (e.g., alphanumeric characters, symbols, etc.). The one or more visual characteristics and/or labels of each face, either alone or in combination, may define an "index value" assigned to each face, which defines at least part of the outcome of the randomizer unit. In one example, the elements of the compartments of the wheel and/or index values of the faces of the die may, either alone or in combination, indicate at least part of a game outcome.

In some implementations, one or more randomizer units may be used independently, simultaneously and/or concurrently in order to produce one or more outcomes corresponding to wagers that the player may place with respect to the game (e.g., winning, losing, and draw). A game outcome may be generated by combining one or more outcomes generated by one or more randomizer units. In one instance, multiple randomizer units may be provided, where each of the randomizer units generates an outcome (e.g., based on the index value of the die and element of the compartment) that defines at least a portion of the game outcome. In such instances, the outcome from one or more of the multiple randomizer units may be combined to generate the game outcome. In another example, a single randomizer unit may be used multiple times to generate multiple outcomes that may be combined to generate the game outcome.

In one example, the outcome of a game may be based on a comparison of two or more values generated according to combining one or more outcomes from one or more randomizer units. For example, a set of randomizer units or a number of outcomes may be combined to determine a value for a "hand" in a round of play of the game. The outcome(s) of the one or more randomizer units may be combined and/or compared (e.g., between two sets of randomizer unit values). Each set of randomizer units and/or outcomes may be associated with one of a multiple players, and/or with different positions or outcomes that one or more players may choose or wager within a game.

Figure 1B:
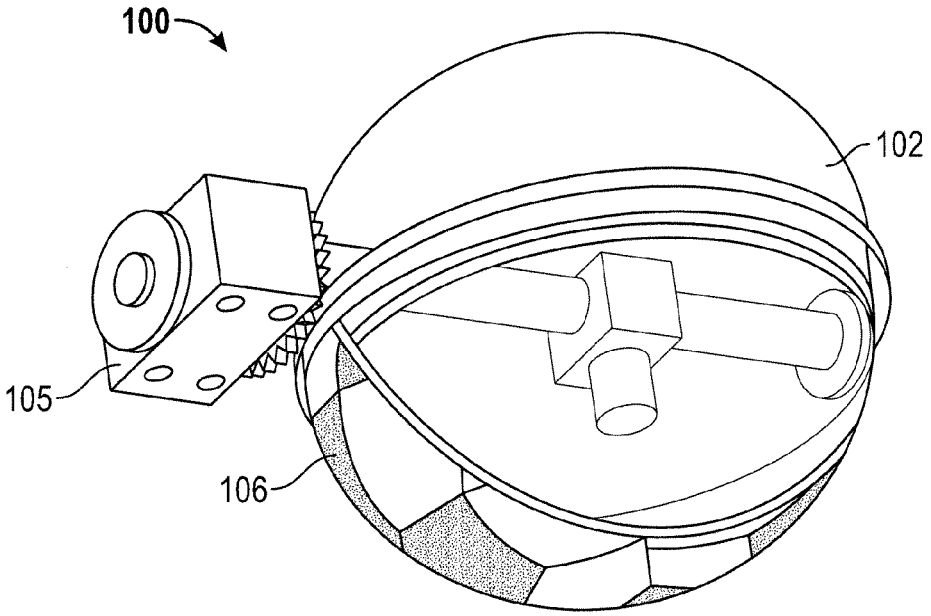

FIGS. 1A and 1B illustrate an example randomizer unit 100 for use within an apparatus for facilitating play of a game. The randomizer unit 100 includes a wheel 101, a cover 102, a housing, a die 104, and a rotator 105.

Figure 2:
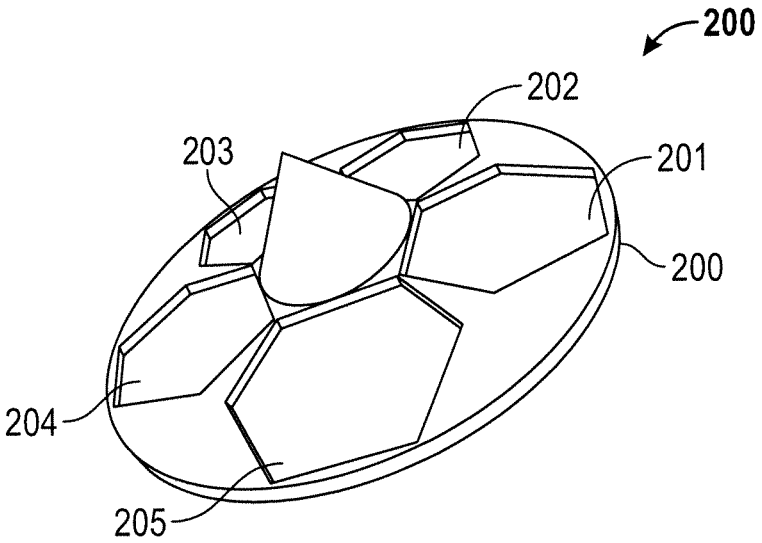
FIG. 2 illustrates an example wheel for use with the randomizer unit of the game apparatus for facilitating game play.

In some implementations, the platform 101 is divided into one or more compartments, with each compartment having a label (e.g., alphanumeric characters, symbols, etc.) and/or a visual characteristic (e.g., a color) representing an element defining a value. FIG. 2, described in more detail below, illustrates an example wheel 200 for use with the randomizer unit 100. Each compartment of the wheel 101 provides a pocket where the die 104 may land, to simulate at least part of a game outcome.

According to one or more implementations, cover 102 is an encasing (e.g., a clear cover as shown in FIG. 1) having a shape (e.g., a dome shaped cover) designed to allow the cover 102 to be coupled the wheel 101 to form the housing enclosing the die 104.

Figure 3A:
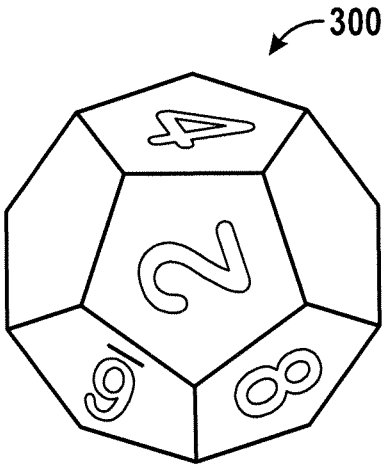
FIGS. 3A and 3B illustrate a top view and bottom view of an example die for use with the randomizer unit of the game apparatus for facilitating game play.
Figure 3B:
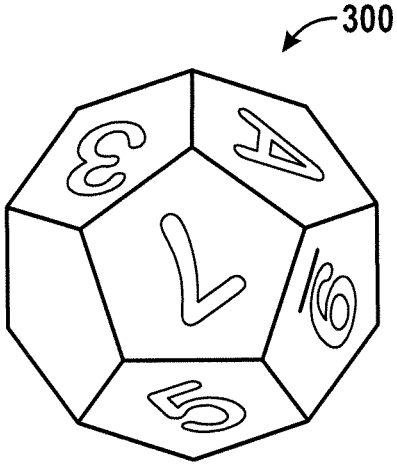

Die 104 may be any polyhedron die. The faces of the die 104 may be labeled with a character (e.g., alphanumeric characters or symbols), and each label and/or face may further be of specific color. Each face of the die may be labeled with a character or symbol. In some implementations, each face and/or face label of the die 104 may have a specific coloring. Based on these labels and/or other visual indicia, each face of the die may be associated with an index value. FIGS. 3A and 3B, described in more detail below, illustrate an example die 300 for use with the randomizer unit 100.

The dice rotator 105 may include a randomization mechanism, for example, including one or more of spinning mechanisms, rotation mechanisms, and vibration mechanisms. In some examples, the dice rotator may include means for initiating and/or terminating the randomization. For example, in one embodiment, the dice rotator 105 may include a brake (e.g., manually activated by a player) to terminate operation of the randomization mechanism. In one example, is made up of a two gear assembly for rotating the wheel 101 and to cause a "spin" resulting from a randomized movement of the wheel 101 and die 104. In one embodiment, a spin results in an outcome from the randomizer unit 100 which is used to determine a game outcome and settle all wagers in a round of play of the game.

In some implementations, the dice rotator 105 is configured to spin in alternate directions at variable speeds and number of rotations to generate random results and to generate a randomized outcome as a result of a spin. In one example, the rotator may further include means for vibrating the wheel, or causing other randomizing motion of the wheel 101 and/or die 104. In one example, the initiation, termination, speed and intensity of the rotator 105 may be adjustable to generate a randomized movement (e.g., rotation and/or vibration) of the wheel 101 and/or die 104. In one example, one or more of the initiation, termination, speed and/or intensity of the rotator 105 may be controlled by a player manually, and/or automatically by a mechanism. A spin occurs each time the rotator 105 is initiated to cause a movement of the wheel 101 and/or die 104, and concludes when the wheel 101 and/or die 104 come to rest in a position that defines an outcome of the randomizer unit 100.

In some implementations, the randomizer unit 100 is designed to facilitate hiding the housing and thus the status of the compartments of wheel 101 and die 104 during a spin or some portion of a spin and/or game play according to one or more rules. In one example, the cover 102 is made of material with variable transparency (e.g., smart glass) such that the transparency of the cover can be adjusted to hide or show the housing, and thus, the surface of the wheel 101 and die 104, which alone or in combination make up at least part of a game outcome. In another example, a second outer cover 106 as shown, in FIG. 1, may be used to hide the housing during some portion of game play.

In one example, the outer cover 106 is coupled to the dice rotator 105, forming a single unit. In one example, the outer cover 106 and dice rotator 105 move independently from one another.

The randomizer unit 100 may be used for providing an outcome that defines at least a portion game outcome under one or more circumstances and according to various game rules and criteria. In one example, the portion of the outcome of the game represented by the randomizer unit 100 may be defined by the element associated with the compartment of the wheel 101 in which the die 104 lands after a spin, the index value of a face of die 104 (e.g., the face pointing up) and/or the combination thereof.

In one example, the number of compartments of the wheel 101 and/or the number of faces of the die 104, as well as the labels and/or visual characteristics of the wheel 101 and/or die 104 may be customized according to the rules and criteria of the game for which outcomes are being simulated using the randomizer unit 100. In some examples, the outcome of the randomizer unit 100 alone or in combination with one or more other randomizer units and/or one or more other outcomes generated by the same randomizer unit 100, may be used to determine the results of one or more outcomes of a game, and/or settle wagers in a round of play of a game.

The value generated by the randomizer unit 100 may for example simulate casino game outcomes. For example, the elements of the wheel 101 and/or index values of the die 104 may be utilized to simulate the independent selection of playing cards. The playing cards may be selected from various decks having a number of cards, with various characters and/or symbols and a number of suits/colors. The elements of the compartments of the wheel 101 may for example be utilized to represent the different suits and/or colors of the deck of cards. In one example, the index values of the faces of die 104 may represent the characters and/or symbols of each card of a suit and/or color. The faces and/or elements of compartments, may for example, be marked with different characters, symbols or images, including for example jack, queen and king, Chinese characters such as the Chinese gods (e.g., Fu, Lu, Shou), zodiac symbols, images or symbols relating to different sports (e.g., soccer images of a ball, whistle and flag), roman numerals, numeric values, cultural icons, and other such symbols or images. In one example, each of the symbols may be associated with a value (e.g., index value). In one example, the value may be an integer or other value.

For example, the playing cards may include a deck of 48 cards consisting of characters Ace (or 1) through 9, and three face cards and four suits. In another example, the deck of cards includes 60 cards consisting of Ace (or 1), 2 through 9, three face cards and five suits. In one example, the face cards may be different symbols or images, including for example jack, queen and king, Chinese characters such as the Chinese gods Fu, Lu, Shou, zodiac symbols, images or symbols relating to different sports (e.g., soccer images of a ball, whistle and flag), roman numerals, numeric values, cultural icons and other such symbols or images. In one example, each of the suits of the cards may be represented by an element of the compartments of wheel 101 and/or one or more of the card values (e.g., numeric and/or face values) may be represented by the index values of the die 104. In such manner, cards games such as Baccarat, Poker and/or Blackjack or Pontoon may be simulated using one or more randomizer units such as the randomizer unit 100.

In another example, the compartment elements and/or die index values may be combined to provide a value selection of a tile, for example, in a game such as Pai Gow. The value of the wheel 101 and/or die 104 may also be utilized to simulate outcomes for games such as Craps or Sic Bo.

FIG. 2 illustrates an example wheel 200 for use with the randomizer unit of the game apparatus for facilitating game play. In one example, the wheel 200 may be used as the wheel 101 of the randomizer unit 100 illustrated in FIG. 1. As shown, the wheel 200 includes five compartments 201, 202, 203, 204 and 205 representing five distinct elements and distinguishable by a unique visual characteristic such as color (not shown). In some embodiments, each element is associated with a value corresponding to at least a part of an outcome of the randomizer unit (e.g., randomizer 100).

The wheel 101 and/or compartments 201-205 of the wheel 200 may be manufactured using material that allows for reading a value of the die from beneath the surface of the wheel 200 (e.g., using a camera). For example, when a die (e.g., die 104) lands within one of the compartments 201-205, the index value of the face of the die that points up (e.g., toward the cover of the randomizer unit) may define a portion of the outcome of the game. However, the value of the die may be determined using a camera installed below the randomizer unit, which can read the index value of the face of the die adjacent to the compartment surface, and based on that, the index value of the face pointing up is determined (e.g., the face opposite to the face written by the camera). Furthermore, the element represented by the compartment that the die lands in may be determined using the camera for determining an outcome of the randomizer unit.

FIGS. 3A and 3B illustrate a top view and bottom view of an example die 300 for use with the randomizer unit of the game apparatus for facilitating game play. Die 300 is shown as a dodecahedron or 12-sided die. Each face of the die 300 is labeled with a character (e.g., alphanumeric characters, symbols). For example, the die 300 is shown as having numeric values and characters. Each character represents an index value. The index value of the face of the die 300, for the purpose of determining a game outcome, may be represented by a face of the die 300 pointing up when the die 300 lands onto the wheel (e.g., wheel 101) of the randomizer unit and is viewable from top of the randomizer unit.

Figure 4:
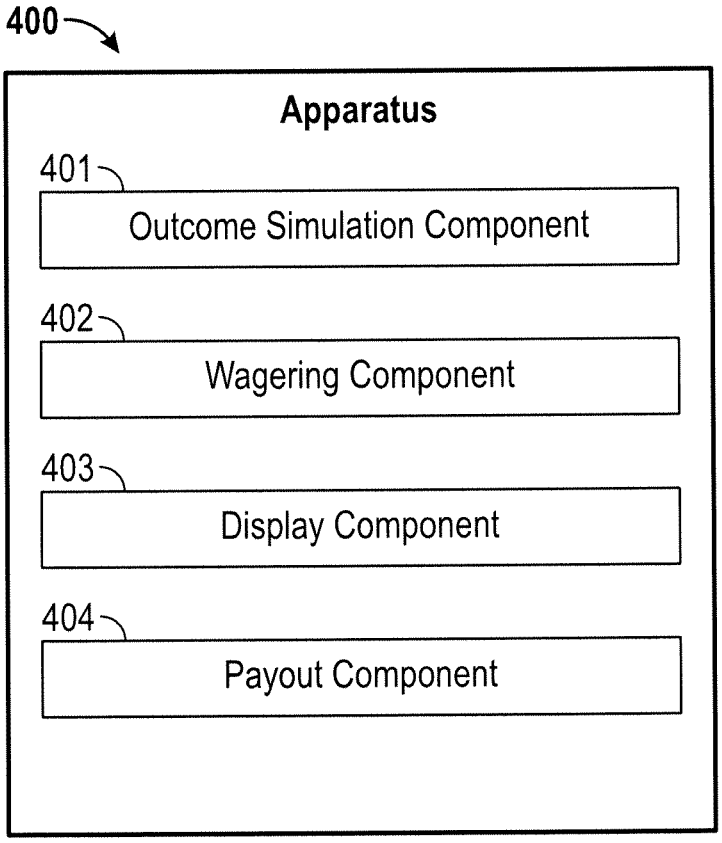
FIG. 4 illustrates an example apparatus for simulating game play.

FIG. 4 illustrates an example apparatus 400 for simulating game play. The apparatus 400 includes an outcome simulation component 401, a wagering component 402, and a display component 403.

The outcome simulation component 401 may include one or more randomizer units (e.g., randomizer unit 100), in one or more sets, for simulating one or more game outcomes (e.g., outcomes that players can wager on). In one example, the outcome simulation unit may be implemented using various randomization mechanisms or tools, including but not limited to, dice, wheels, cards, blocks or other tools or mechanisms capable of generating random values or outcomes for simulating game play. In one example, the outcome simulation unit may include various randomization mechanisms, for example, including one or more of spinning mechanisms, rotation mechanisms, and vibration mechanisms. In some examples, the randomization unit may include means for initiating and/or terminating the randomization. For example, in one embodiment, the dice rotator 105 may include a brake (e.g., manually activated by a player) to terminate operation of the randomization mechanism. In one example, the randomizer units may be implemented similar to the randomization unit 100 of FIG. 1.

Figure 5:
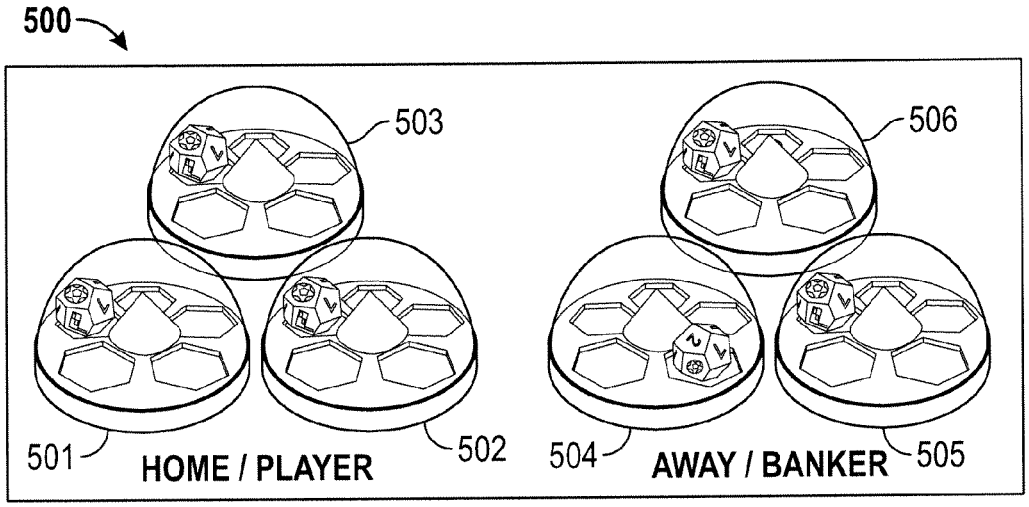
FIG. 5 illustrates an example of an outcome simulation component for use for simulating game play.

In some implementations, the outcome simulation component 401 includes one or more randomizer units each generating a portion of an outcome of a game according to game rules and criteria. For example, the number of randomizer units for the apparatus may include one or more sets of randomizer units, each set including randomizer units for the number of individual outcomes representing a total outcome (e.g., a hand). In one example, each set of randomizer units represents a total outcome, generated from the outcome of each randomizer unit in the set. The total outcome of each set may be compared to a threshold or rule value or to other total outcomes of other sets of randomizer units to determined one or more game outcomes and settle wagers. An example outcome simulation component is illustrated in FIG. 5, described in more detail below.

Figure 6A:
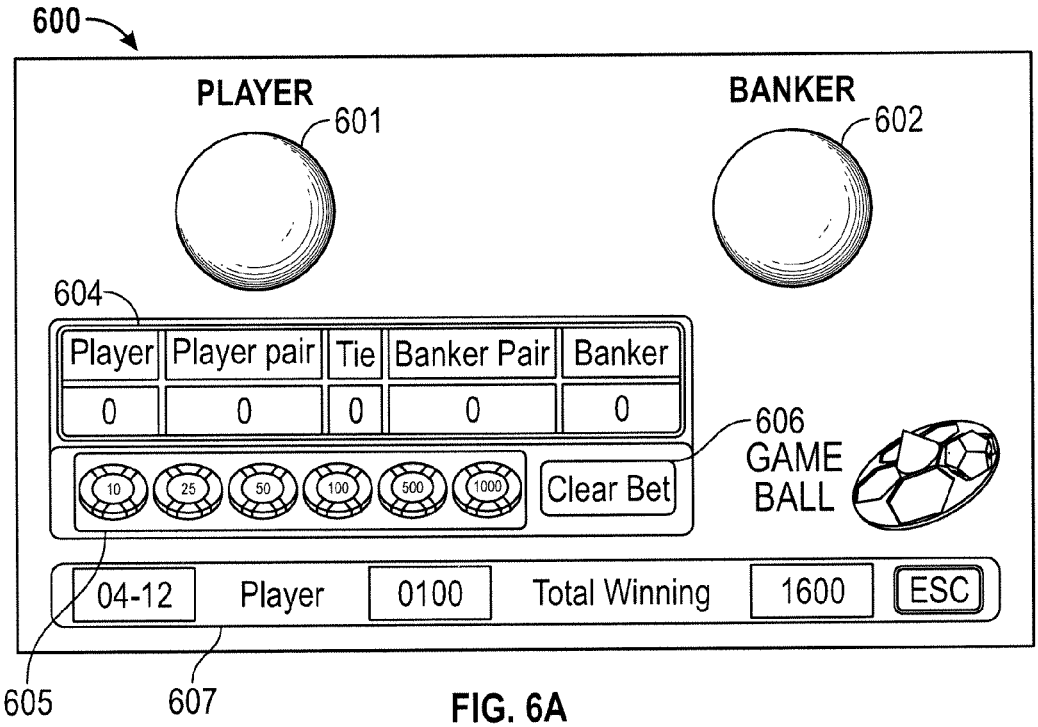
FIGS. 6A, 6B and 6C illustrate example user interfaces for use with an apparatus for simulating game play.
Figure 6B:
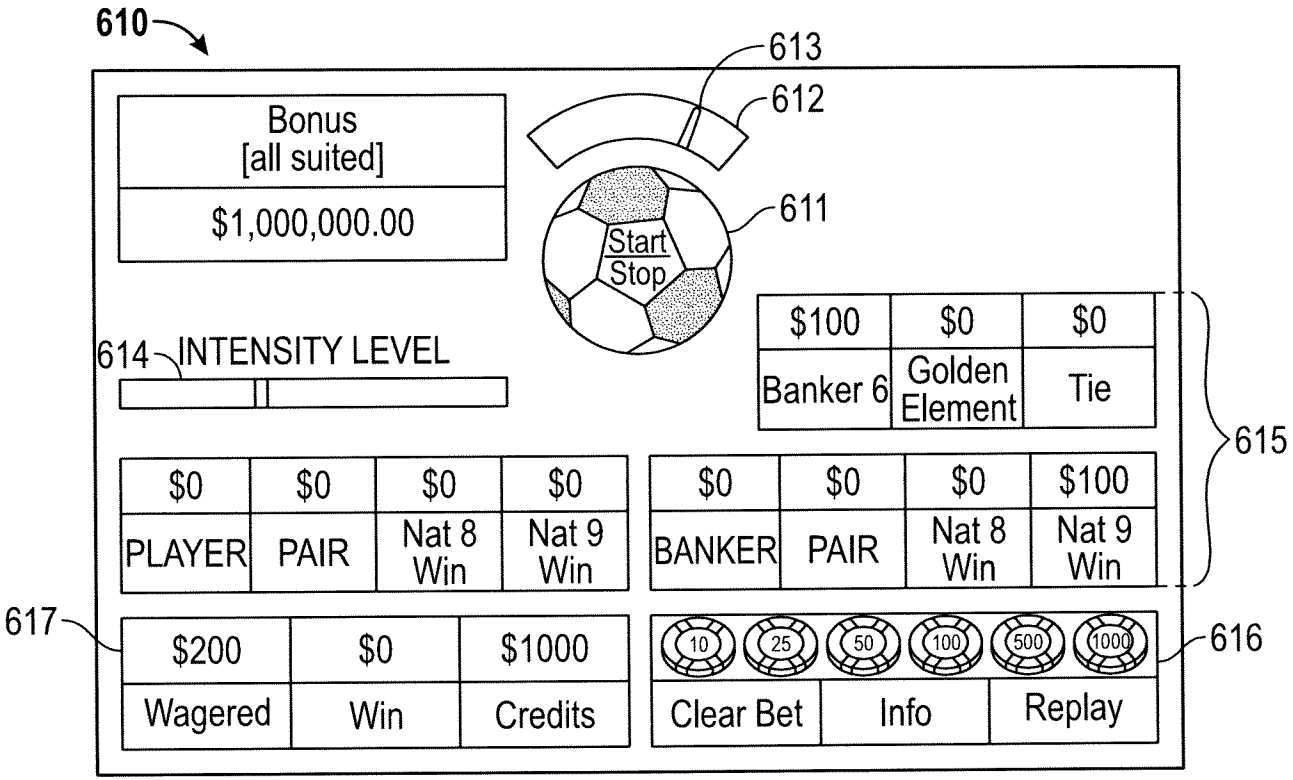
Figure 6C:
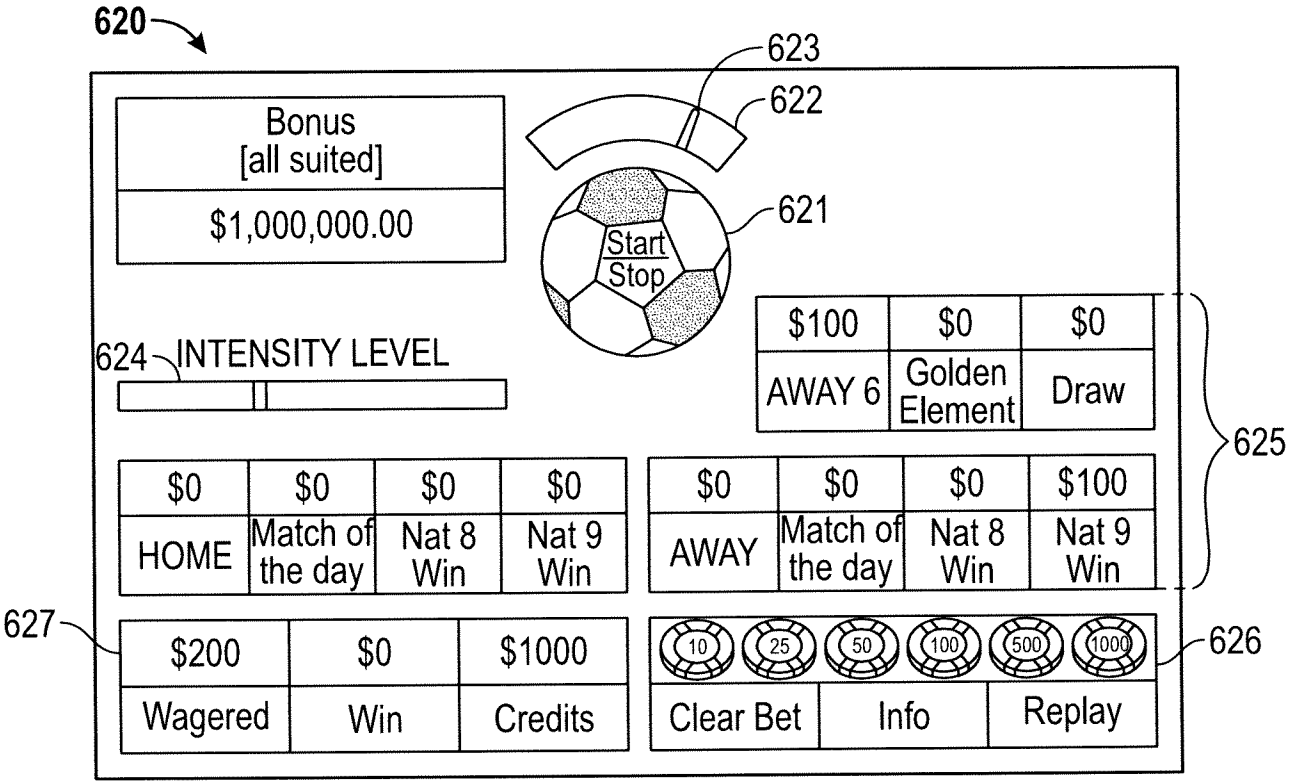

According to one or more implementations, the wagering component 402 includes one or more mechanisms for facilitating placing wagers on the one or more game outcomes generated by the randomizer units of the outcome simulation unit 401. In some implementations, the wagering mechanisms of the wagering component 402, may, for example, include one or more of machine implemented buttons, touch screens, and/or other machine-implemented mechanisms for placing wagers, initiating/terminating spins and/or rounds of play, and/or otherwise taking part in a game or round of play of the game simulated using the apparatus 400. FIGS. 6A, 6B and 6C illustrates various examples of a user interface for providing information about the game to a player and/or allowing the player to operate the apparatus 400 for wagering on outcome(s) of the game.

Figure 7A:
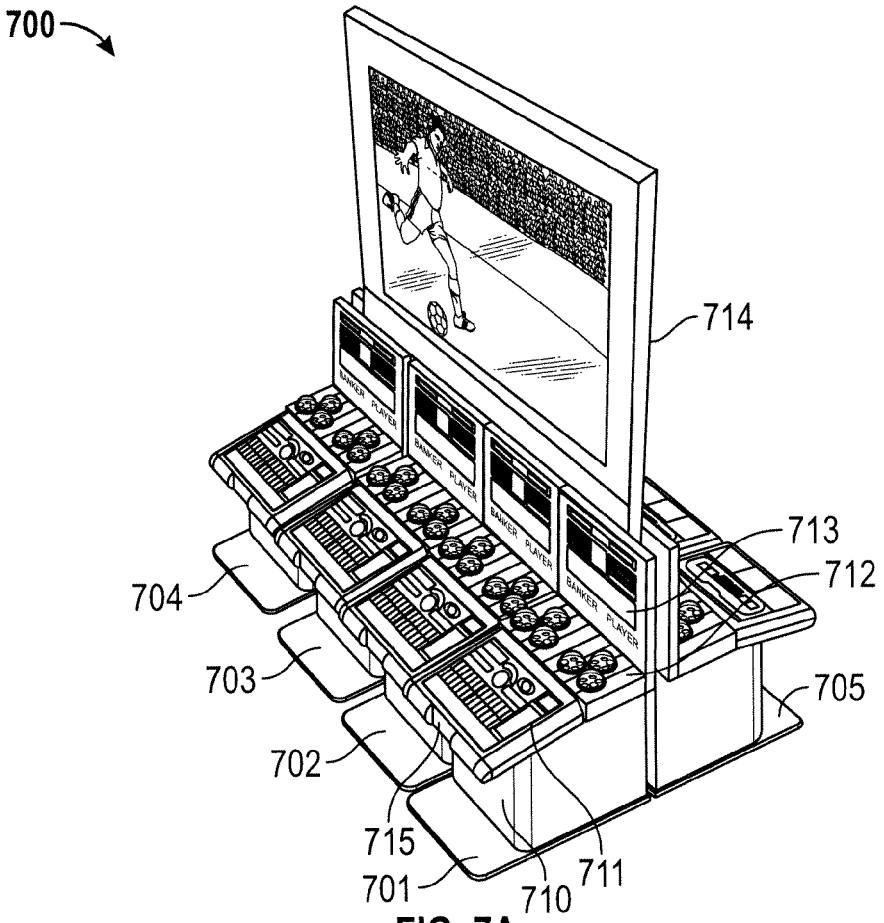
FIG. 7A illustrates an example set of apparatuses for simulating game play.
Figure 7B:
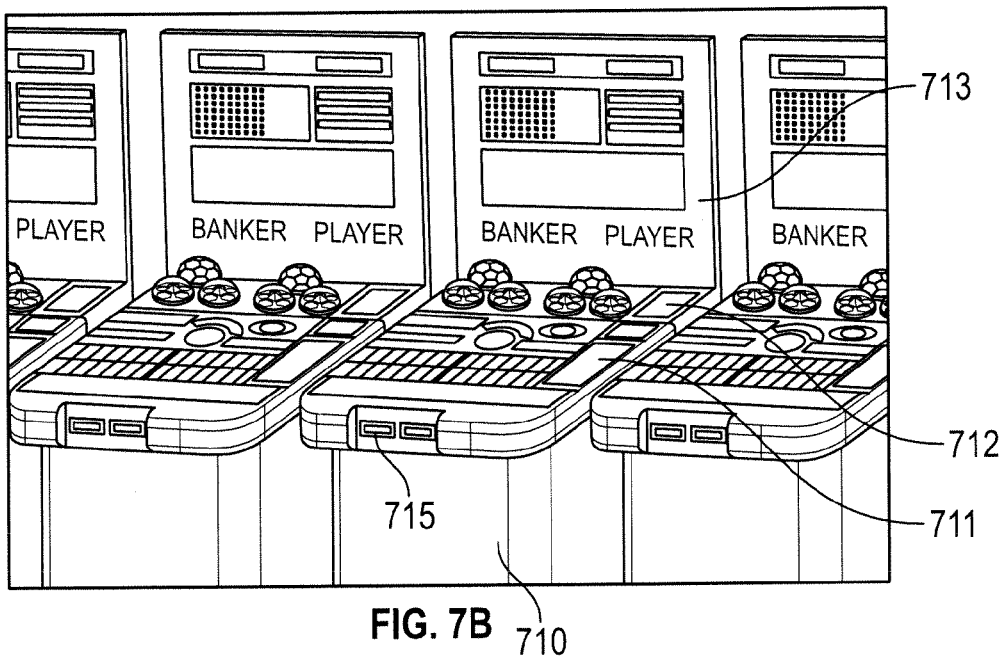
FIG. 7B illustrates an alternative view of the set of the apparatuses of FIG. 7A.
Figure 8:
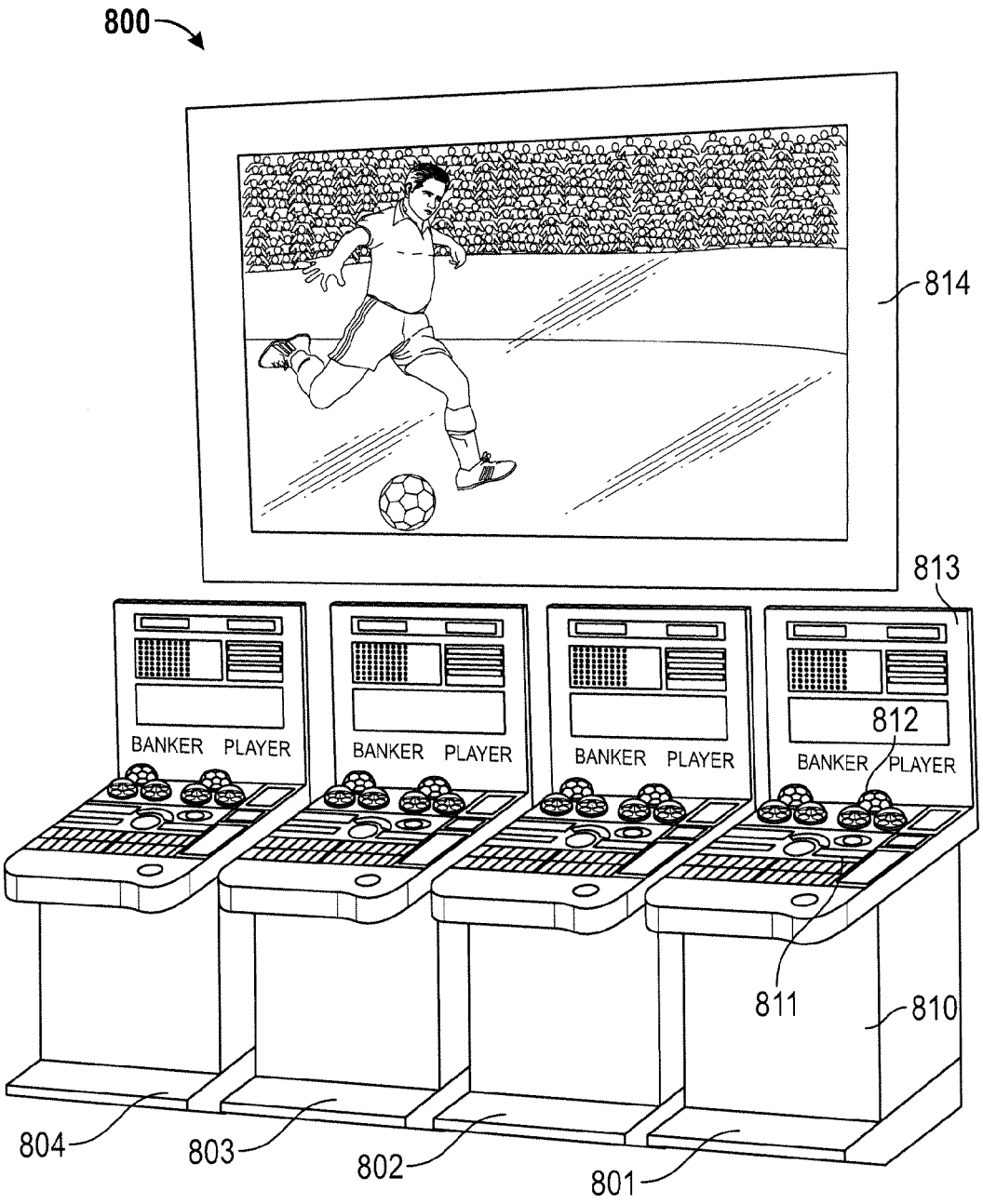
FIG. 8 illustrates a second example set of apparatuses for simulating game play.

In one example, apparatus 400 is a single console or terminal for allowing a single player to play the game being simulated by the apparatus 400, including for example, wagering on the game outcomes generated by the outcome simulation component 401. FIGS. 7A, 7B and 8, described in more detail below, illustrates example apparatuses allowing for a single player wagering of the outcome of the outcome simulation component 401. In such examples, the wagering component 402 includes one set of mechanisms for allowing a single player to place wagers for the outcome(s) generated by the outcome simulation unit 401.

Display component 403 may include one or more displays for providing game related information and graphics to the player. In one example, the display component 403 includes a main display for displaying game information such as game outcomes, wagering results, a visual representation of the randomizer unit(s) of the outcome simulation component 401, information and data from the outcome simulation component 401, and/or wagering information from the wagering component 402. In one example, the wagering component 402 and the main display of the display component 403 may be implemented as a single display having touch screen capabilities for allowing a player to place wagers.

In some examples, the display component 403 may include one or more secondary displays for displaying various images, videos or other visual indicia relating to the game, advertisements, marketing material, or other visual images or videos for display to the player. The main display and secondary display may include one or more of a touch screen display, a panel, a holographic display, a screen (e.g., LED or LCD) or other display.

In some examples, one or more displays of the display component 403 (e.g., the main display or secondary displays) may include a tablet or other mobile display mechanism for use by the player.

Payout component 404, in one example, may be configured to settle wages placed, for example, using the wagering component 402, according to the outcome generated, for example, by the outcome simulation component 401. In one example, the wagering component may have access to data regarding particular returns for particular wagers relating to a specific game. In some examples, the payout component may further have access to rules and/or regulations regarding settling of wagers and/or payouts in one or more games.

The various components of the apparatus 400 may be implemented as a processor-based game console implemented in a single cabinet, or multiple cabinets, or as a live play table for simulating a game outcome, for example, by using one or more randomizer units as described in FIG. 1. The one or more components of the apparatus 400 may be coupled to one either via wired or wireless connection, or otherwise in communication with one another.

Figure 9A:
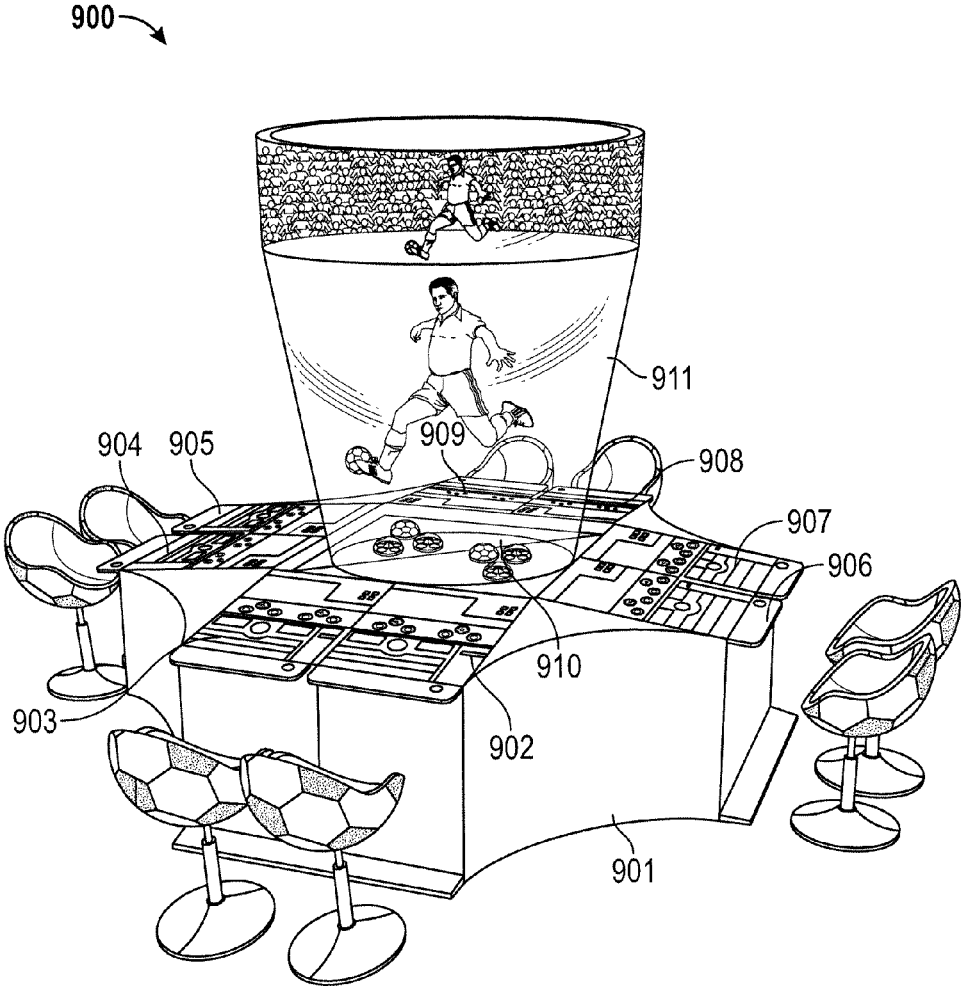
FIG. 9A illustrates an example multi-station apparatuses for simulating game play.
Figure 9B:
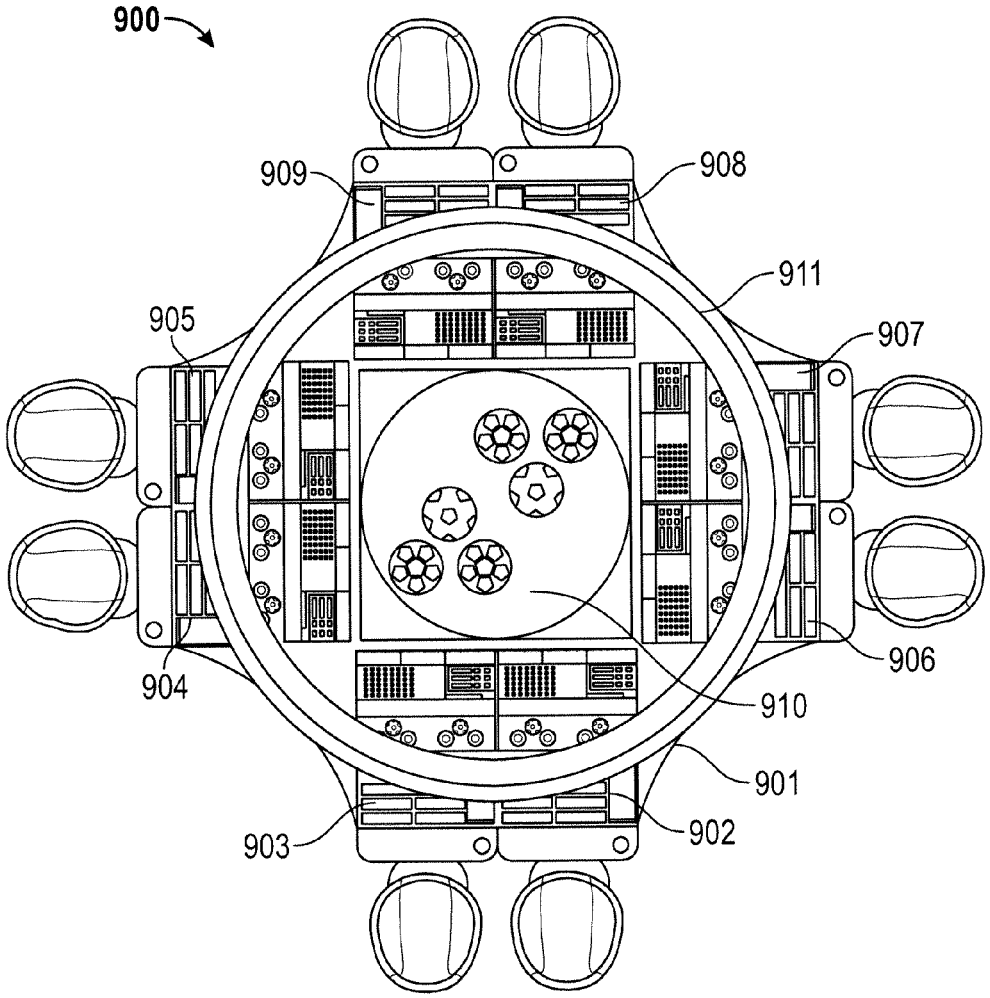
FIG. 9B illustrates an alternative view of the apparatus of FIG. 9A.

In one example, apparatus 400 is a made up of multiple stations or terminals allowing multiple player to play the game being simulated by the apparatus 400, including for example, wagering on the game outcomes generated by the outcome simulation component 401 of apparatus 400. FIGS. 9A and 9B, described in more detail below, illustrate various examples of an apparatus having a plurality of sets of wagering mechanisms for allowing multi-player wagering of a game outcome generated by a common randomizer component. In such instances, the wagering component 402 may include two or more sets of mechanisms, for allowing multiple players to place wagers on the outcome(s) generated by the outcome simulation unit 401.

Figure 10A:
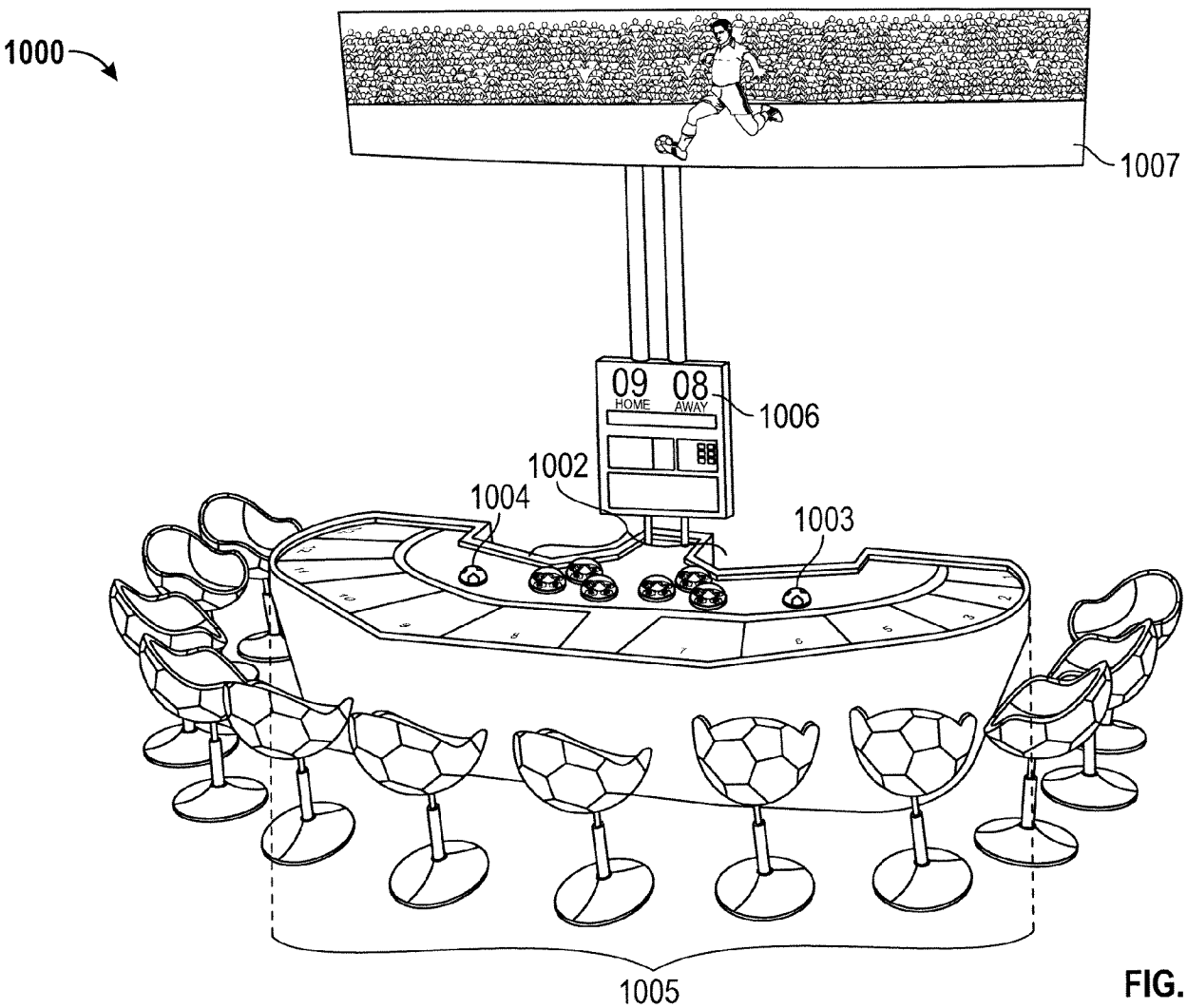
FIG. 10A illustrates an example apparatus for simulating live game play.
Figure 10B:
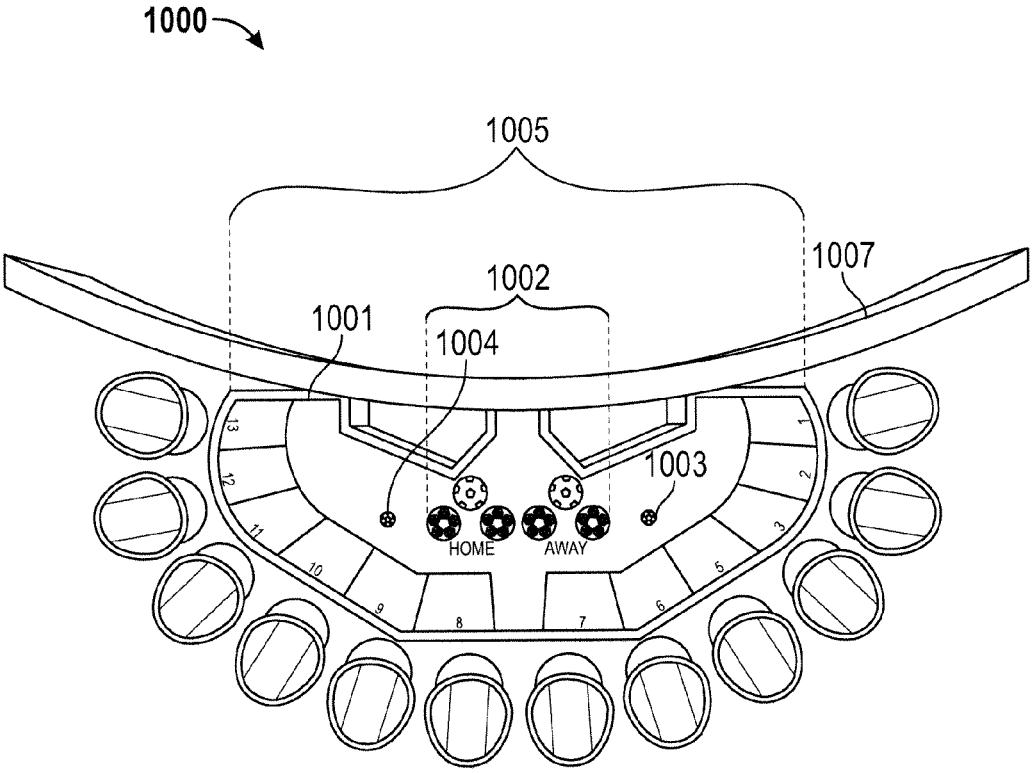
FIG. 10B illustrates an alternative view of the apparatus of FIG. 10A.

In some examples, the apparatus 400 may provide for live play of a game where the outcome of the game wagers are determined using one or more randomizer units of the outcome simulation component 401. In such examples, a single or multiple players may wager on the outcomes generated by the outcome simulation component 401 of the apparatus 400. In one example, the wagering component 402 of such apparatus 400 may include individual player stations on a live table and other mechanisms for facilitating live play and wagering (e.g., including a live dealer, chips, etc.). FIGS. 10A and 10B, described in more detail below illustrate an example apparatus facilitating live play using a table for allowing wagering on a game outcome.

FIG. 5 illustrates an example of an outcome simulation component 500 for use for simulating game play. For example, the outcome simulation component 401 of the apparatus 400 may be implemented as shown with respect to randomizer component 500 of FIG. 5. As discussed above, an outcome simulation component 500 may be used to simulate various game outcomes, in association with a game console (e.g., a casino game console) or in live play (e.g., a casino table game). In one example, the game play may comprise various casino games such as Baccarat, Poker, Sic Bo, Craps, Roulette, Pai Gow, Black Jack, Pontoon, slot games (e.g., slots combination), lottery games, electronic table games, or other similar games (e.g., various other casino games, wagering games, or other games).

The outcome simulation component 500 includes randomizer units 501, 502, 503, 504, 505 and 506 for simulating game outcomes for a game according to rules and criteria of the game. For example, a card game such as a Baccarat game may be simulated using the outcome simulation component 500. One or more of the randomizer units 501-506 may be implemented using the randomizer unit 100 of FIG. 1. In one example, randomizer units 501, 502 and 503 form a first set of randomizer units representing a first hand value (e.g., a player hand or home hand) and randomizer units 504, 505 and 506 form a second set of randomizer units representing a second hand value (e.g., a banker hand or away hand).

In one example, one or more of the randomizer units 501-506 may be equipped with means for allowing the value generated by the randomizer to be hidden during a spin or during some portion of game play (e.g., according to rules and criteria of the game). For example, in one example, one or more of the randomizer units 501-506 have a smart glass cover with variable opacity. In another example, one or more of the randomizer units 501-506 include an outer cover for hiding the results of the spin of the randomizer unit for a period of time during game play. In some examples, hiding the results of the spin of the randomizer units 501-506 allows for wagering even after the game play has been initiated causing the spin of the randomizer units 501-506. In one or more implementations, the hiding of the results of one or more randomizer units 501-506 may also facilitate selective use of the results of each randomizer unit in the final outcome according to various game rules or other factors.

FIG. 6A illustrates an example user interface 600 for use with an apparatus for simulating game play. In one example, the user interface 600 is used to facilitate wagering for the apparatus (e.g., as part of the wagering component 402 of FIG. 4). User interface 600, may, for example, facilitate wagering in a game of baccarat or other card games.

According to various implementations, user interface 600 includes wagering mechanisms including a first button 601 for placing a first wager on a first outcome generated by a first set of randomizer units of the apparatus (e.g., randomizer units 501, 502, and 503 of the outcome simulation component 500 of FIG. 5) representing a player hand and a second button 602 for placing a second wager on a second outcome generated by a second set of randomizer units of the apparatus (e.g., randomizer units 504, 505, and 506 of the outcome simulation component 500 of FIG. 5) representing a banker hand. In some examples, selection of one of the buttons 601 and 602 may cause an initiating and/or terminating of a spin of the randomizer units of the apparatus. In one example, the buttons 601 and 602 may be physical/mechanical buttons. In another example, buttons 601 and/or 602 may be implemented using touch screen technology.

In addition, the user interface 600 includes an outcome wagering area 604 facilitating placing bets for one or more outcomes generated by a randomizer component (e.g., outcome simulation component 401 of FIG. 4 and/or outcome simulation component 500 of FIG. 5). For example, the outcomes may include a player hand, a banker hand, a player pair, a banker pair or a tie. In one example, a player is able to select each outcome displayed in the outcome wagering area 604 to place a selected bet (e.g., selected through the wager selection area 604) on a specific outcome.

A wager selection area 605 is provided, facilitating selection of a wager amount. For example, the wager selection area 605 displays a number of chips, with various values, such that the player is able to select a chip value to place a wager on one or more of the possible outcomes, such as, player hand, banker hand, a player pair, a banker pair or a tie. A "clear bet" button 606 is provided for allowing the player to clear all bets placed on the different outcome selections.

Furthermore, information regarding statistics of the game may also be displayed within the statistics area 607 of the user interface 600, including one or more of the credits of the player, the amount wagered and total winnings.

FIG. 6B illustrates an example user interface 610 for use with an apparatus for simulating game play. In one example, the user interface 610 is used to facilitate wagering at the apparatus (e.g., as part of the wagering component 402 of FIG. 4). The example user interface 610, may, for example, be provided for display to facilitate a game of baccarat or other card games and/or casino games.

The user interface 610 includes one or more mechanisms for initiating game play and wagering on outcomes of a game (e.g., as part of the wagering component 402 of FIG. 4). For example, a "stop/start" button 611 is provided for initiating a spin at the apparatus for simulating game play. A spin meter 612 is also provided, and may indicate when the player may, after initiating the spin, terminate the spin using the stop/start button 611. For example, a lever 613 of the spin meter 612 may move as a spin progresses, and a player may be able to terminate the spin, using the start/stop button 611, according to the location of the lever 613. In one example, a player is able to modify the intensity of the spin using an intensity level meter 614 having a toggle to allow the player to adjust the intensity level for the spin.

The user interface 610 further comprises an outcome wagering area 615 displaying various information regarding the wagers that can be placed by the player. The wagers displayed at the outcome wagering area 615 may include all player wagers for possible game outcomes. For example, the outcomes that the player is able to wager on may include a player hand, a player pair, player natural 8, a player natural 9, a banker hand, a banker pair, a banker natural 8, a banker natural 9, a banker 6, golden elements, and a tie. In one example, a player is able to select each possible outcome displayed in the outcome wagering area 615 to place a selected amount of credit (e.g., selected through the wager selection area 616) on the specific outcome.

A wager selection area 616 is provided, facilitating selection of a wager amount. For example, the wager selection area 616 displays a number of chips, each having a different value, the player is able to select a chip value to place a wager on one or more of the possible outcomes displayed in the outcome wagering area 615. The wager selection area further includes a "clear bet" button for allowing the player to clear all bets placed on the different outcome selections, an "info" button to provide further information to the player regarding the game, wagers, or other information and a "replay" button to allow the player to replay the same round of play.

Information regarding statistics of the game may also be displayed within the statistics area 617 of the user interface 610, including the amount wagered, winnings, credits. In one example, as the user places a wager, the amount of wager is subtracted from the credits and added to the wagered value shown in statistics area 617.

FIG. 6C illustrates an example user interface 620 for use with an apparatus for simulating game play. In one example, the user interface 620 is used to facilitate wagering at the apparatus (e.g., as part of the wagering component 402 of FIG. 4). The example user interface 620, may, for example, be provided for display to facilitate a game of baccarat or other card games and/or casino games.

The user interface 620 includes one or more mechanisms for initiating game play and wagering on outcomes of a game (e.g., as part of the wagering component 402 of FIG. 4). For example, a "stop/start" button 621 is provided for initiating a spin at the apparatus for simulating game play. A spin meter 622 is also provided, and may indicate when the player may, after initiating the spin, terminate the spin using the stop/start button 621. For example, a lever 623 of the spin meter 622 may move as a spin progresses, and a player may be able to terminate the spin, using the start/stop button 621, according to the location of the lever 623. In one example, a player is able to modify the intensity of the spin using an intensity level meter 624 having a toggle to allow the player to adjust the intensity level for the spin.

The user interface 620 further comprises an outcome wagering area 625 displaying various information regarding the wagers that can be placed by the player. The wagers displayed at the outcome wagering area 625 may include all player wagers for possible game outcomes. For example, the outcomes that the player is able to wager on may include a home hand, a home pair, home natural 8, a home natural 9, an away hand, an away pair, an away natural 8, an away natural 9, an away 6, golden elements, and a tie. In one example, a player is able to select each possible outcome displayed in the outcome wagering area 625 to place a selected amount of credit (e.g., selected through the wager selection area 626) on the specific outcome.

A wager selection area 626 is provided, facilitating selection of a wager amount. For example, the wager selection area 626 displays a number of chips, each having a different value, the player is able to select a chip value to place a wager on one or more of the possible outcomes displayed in the outcome wagering area 625. The wager selection area further includes a "clear bet" button for allowing the player to clear all bets placed on the different outcome selections, an "info" button to provide further information to the player regarding the game, wagers, or other information and a "replay" button to allow the player to replay the same round of play.

Information regarding statistics of the game may also be displayed within the statistics area 627 of the user interface 620, including the amount wagered, winnings, credits. In one example, as the user places a wager, the amount of wager is subtracted from the credits and added to the wagered value shown in statistics area 627.

In one example, the elements displayed in the user interface 620 are identical to those of user interface 610 described in more detail above, with differentiations in terminology. That is, while user interface 610 uses the player/banker traditional terminology, the user interface 620 may use alternative terminology (e.g., home instead of player and away instead of banker). The terminology differentiation allows for customization of the user interface to specific games and concepts.

The specific mechanisms described in FIGS. 6A, 6B and 6C are used for exemplary purposes. It should be understood that any mechanism facilitating input from a user may be used to receive player input. Furthermore, it should be understood that various elements of the display may be modified or moved.

FIG. 7A illustrates an example set of apparatuses 700 for simulating game play. FIG. 7B illustrates an alternative view of the set of apparatuses 700 of FIG. 7A. The set of apparatus 700 includes a plurality of casino game consoles. For illustration one or more casino game consoles 701-705 visible in FIG. 7A are labeled, however, the apparatus set 700 may include various number of consoles (e.g., eight). In one example, each console 701-705 is a fully or partially automated electronic table game. The set of apparatuses 700 may allow simulation of a game, such as a game of baccarat or other card games and/or casino games. Each of the consoles 701-705 may for example embody the apparatus 400 described above with respect to FIG. 4.

The various components of game console 701 are labeled and described in detail herein. It should be understood that one or more consoles 701-705 (and other consoles of the set of apparatuses 700) include same or similar components. As shown, game console 701 includes a cabinet 710, a wagering component 711, an outcome simulation component 712, a display 713 and a currency input 715. The wagering component 711 may be implemented in a manner similar to the wagering component 402 of the apparatus 400 of FIG. 4 and/or including the user interface 600 of FIG. 6A. The outcome simulation component 712 may be implemented in a manner similar to the outcome simulation component 401 of the apparatus 400 of FIG. 4 and/or the outcome simulation component 500 of FIG. 5. The display 713 may be implemented in a manner similar to the main display of the display component 403 of the apparatus 400 of FIG. 4. The currency input 715 may include any means of providing currency or credits for wagering on a game outcome simulated using the game console 701. In one example, the currency input 715 may include a currency note and/or ticket input validator. Various types of currency including cash, chips, cards, credits, tickets and other items having a defined or variable value may be used in connection with the currency input 715. In some examples, the player may also be able to provide currency for wagering through alternative means such as through a network or other means where no physical currency object is needed.

In addition, a secondary display 714 (e.g., similar to the secondary display of the display component 403 of the apparatus 400 of FIG. 4) is provided for all of the consoles of the set 700.

FIG. 8 illustrates a second example set of apparatuses 800 for simulating game play. In one example the set of apparatuses 800 includes a plurality of consoles 801-804 (e.g., casino game consoles). In one example, each console 801-804 is a fully or partially automated electronic table game. The set of apparatuses 800 may allow simulation of a game, such as a game of baccarat or other card games and/or casino games. Each of the casino game consoles 801-804 may for example embody a gaming apparatus similar to the apparatus 400 described above with respect to FIG. 4.

The various components of game console 801 are labeled and described in detail herein. It should be understood that one or more game consoles 801-804 include same or similar components. Game console 801 includes a cabinet 810, a wagering component 811, an outcome simulation component 812 and a display 813. The wagering component 811 may be implemented in a manner similar to the wagering component 402 of the apparatus 400 of FIG. 4 and/or including the user interface 610 of FIG. 6A or user interface 620 of FIG. 6B. The outcome simulation component 812 may be implemented in a manner similar to the outcome simulation component 401 of the apparatus 400 of FIG. 4 and/or the outcome simulation component 500 of FIG. 5. The display 813 may be implemented in a manner similar to the main display of the display component 403 of the apparatus 400 of FIG. 4.

In some examples, the game console 801 may also include a currency input for providing currency or credits for wagering on a game outcome simulated using the game consoles 801. Various types of currency including cash, chips, cards, credits, tickets and other items having a defined or variable value may be used in connection with the currency input. In some examples, the player may also be able to provide currency for wagering through alternative means such as through a network or other means where no physical currency object is needed.

In addition, a secondary display 814 (e.g., similar to the secondary display of the display component 403 of the apparatus 400 of FIG. 4) is provided for all of the game consoles 801-804 of the set of apparatuses 800.

FIG. 9A illustrates an example multi-station apparatuses 900 for simulating game play. FIG. 9B illustrates an alternative view of the apparatus 900. The apparatus 900 includes a plurality of casino game stations 902-909 (e.g., implemented within a single cabinet 901). Apparatus 900 may be a fully or partially automated electronic table game. Apparatus 900 may allow simulation of a game, such as a game of baccarat or other card games and/or casino games. Apparatus 900 may be implemented in a manner similar to the apparatus 400 described above with respect to FIG. 4.

The apparatus 900 includes a cabinet 901, a plurality of wagering stations 902-909, an outcome simulation component 910, and a display 911. Each wagering station 902-909 may include a wagering component and/or a display. In one example, one or more of the wagering stations 902-909 may include a wagering component implemented in a manner similar to the wagering component 402 of the apparatus 400 of FIG. 4 and/or including the user interface 600 of FIG. 6A, the user interface 610 of FIG. 6B or the user interface 620 of FIG. 6C. In one example, one or more of the wagering stations 902-909 may include a display implemented in a manner similar to the main display of the display component 403 of the apparatus 400 of FIG. 4.

In some examples, one or more of the stations 902-909 may also include a currency input for providing currency or credits for wagering on a game outcome simulated using the apparatus 900. Various types of currency including cash, chips, cards, credits, tickets and other items having a defined or variable value may be used in connection with the currency input. In some examples, the player may also be able to provide currency for wagering through alternative means such as through a network or other means where no physical currency object is needed.

As shown, a single outcome simulation component 910 is shared among all of the wagering stations 902-909. In some examples, each wagering station 902-909 may provide a visual display of the outcome simulation component 910 at the station. The outcome simulation component 910 may be implemented in a manner similar to the outcome simulation component 401 of the apparatus 400 of FIG. 4 and/or the outcome simulation component 500 of FIG. 5.

In addition, a secondary display 911 (e.g., similar to the main and/or secondary display of the display component 403 of the apparatus 400 of FIG. 4) is provided for all of the stations 902-909 of apparatus 900. In some examples, the display 911 may include multiple displays, including, but not limited to a holographic and/or LCD display and may display various graphics such as an advertisement, movie or other video or images.

FIG. 10A illustrates an example apparatus 1000 for simulating live game play. FIG. 10B illustrates an alternative view of the apparatus 1000. Apparatus 1000 may allow simulation of a game, such as a game of baccarat or other card games and/or casino games. The apparatus 1000 may embody at least portions of the apparatus 400 described above with respect to FIG. 4. In one example, apparatus 1000 allows for live play of the game with outcomes simulated using one or more randomizer units.

In some embodiments, the apparatus 1000 includes a table 1001 including an outcome simulation component 1002, wagering mechanisms 1003 and 1004, and a player area 1005 (including player stations labeled as 1-3 and 5-13). The apparatus 1000 further comprises a display 1006 and a secondary display 1007 coupled to the table 1001.

Outcome simulation component 1002 is shared among all of the players associated with the player stations of the table 1001. The outcome simulation component 1002 may be implemented in a manner similar to the outcome simulation component 401 of the apparatus 400 of FIG. 4 and/or the outcome simulation component 500 of FIG. 5.

Wagering mechanisms 1003 and 1004 may comprise buttons or other mechanism for initiating or terminating a spin of the outcome simulation component 1002. In some examples, the mechanism 1003 and 1004 are each assigned to one side or hand in a game (e.g., banker/player, home/away) and may allow for competition among players placing bids for the different sides of the game.

Each player station 1-13 of the player area 1005 may be assigned to an individual player. The player may place various forms of currency on the station. In some examples, the player may place their bets on their specific stations. Various types of currency including cash, chips, cards, credits, tickets and other items having a defined or variable value may be used in connection with the currency input. In some examples, the player may also be able to provide currency for wagering through alternative means such as through a network or other means where no physical currency object is needed. In one example, one or more of the wagering stations 902-909 may include a display implemented in a manner similar to the main display of the display component 403 of the apparatus 400 of FIG. 4.

The primary display 1006 may be implemented in a manner similar to the main display of the display component 403 of the apparatus 400 of FIG. 4. In some examples, various statistics and wagering information for the plurality of players at the table 1001 may be displayed at the display 1006. The secondary display 1007, for example, implemented similar to the secondary display of the display component 403 of the apparatus 400 of FIG. 4, is also provided and may display various graphics such as an advertisement, movie or other video or images.

Figure 11:
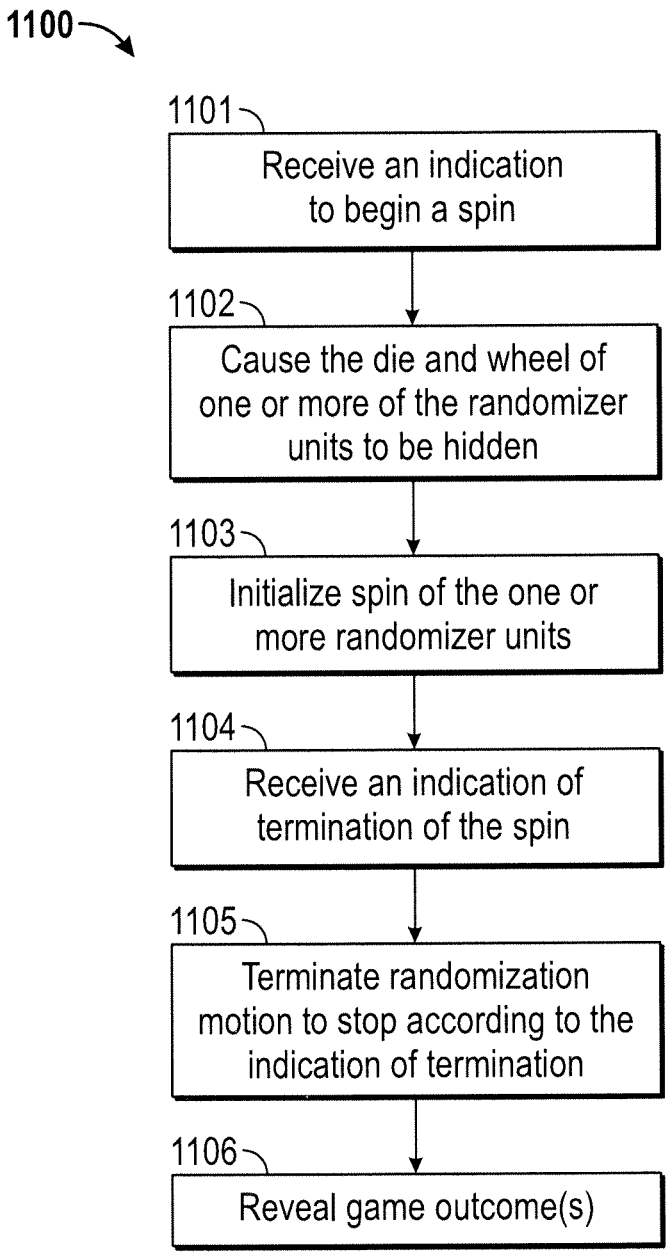
FIG. 11 illustrates an example process for simulating game play using an outcome simulation component including one or more randomizer units.

FIG. 11 illustrates an example process 1100 for simulating game play using an outcome simulation component including one or more randomizer units. In one example, the process 1100 may be implemented using an apparatus (e.g., apparatus 400 of FIG. 4, apparatus 700 of FIGS. 7A and 7B, apparatus 800 of FIG. 8, apparatus 900 of FIGS. 9A and 9B, and/or apparatus 1000 of FIGS. 10A and 10B) having an outcome simulation component (e.g., outcome simulation component 400 of FIG. 4 and/or outcome simulation component 500 of FIG. 5) that may be implemented using one or more randomizer units (e.g., randomizer unit 100 of FIG. 1).

In step 1101, the apparatus receives an indication to initiate a spin of one or more randomizer units of the apparatus. In some example, the indication may be received, for example, in response to a player placing a wager, pressing a button or otherwise causing an initiation of a spin. In one example, prior to step 1101, the apparatus receives one or more wagers for one or more possible outcomes of a round of play. Once the wagers are placed, the round of play may proceed, for example, in response to a player initiation of round of play including a start spin button.

In step 1102, the apparatus causes the die and wheel of one or more of the randomizer units to be hidden. For example, as described above, one or more randomizer units may be equipped with an outer cover or a cover made of material that allows for hiding the housing of the randomizer unit during a spin. In one example, the housing of all of the one or more randomizer units involved in simulation of game play and generating one or more outcomes of the game may be hidden. In another example, only the housing of specific randomizer units of the one or more randomizer units may be hidden. For example, in one embodiment, during a spin, all randomizer unit housings may be hidden in order to allow for betting after initiation of the spin. In other examples, only certain randomizer units corresponding to game outcomes usually not shown during game play until a specific event may be hidden until the specific event occurs. In some examples, the housing of one or more randomizer units may be hidden before receiving an indication to initiate a spin in step 1101. In some examples, step 1102 may not be performed, and the randomizer units are not hidden before initiating the spin.

In step 1103, the apparatus initiates a spin of the one or more randomizer units. For example, a dice rotator of the one or more randomizer units is set in motion and causes a randomization motion of the randomizer unit wheel. In one example, all of the one or more randomizer units may be set in motion at the same time, while in other embodiments, only certain randomizer units are set in motion, and/or randomizer units are set in motion in a specific order or at specific times that may be different from one another.

In step 1104, the apparatus receives an indication of a termination of the spin. In some example, the indication may be received, for example, in response to a player placing a wager, pressing a button or otherwise causing a termination of the spin.

In step 1105, the randomization motion of the one or more units set in motion in step 1102 is terminated, such that the one or more randomizer units come to rest. In response to the randomized motion, the dice of the one or more randomizer units land in a selected compartment and/or on a specific face, thus generating a value (e.g., based on the compartment element and/or die face index value).

In step 1106, one or more game outcomes are revealed. For example, one or more randomizer units having a housing that may have been hidden (e.g., in step 1102) may be revealed. In some examples, the revealing of the hidden housing of a randomizer unit may be based on various game rules and/or criteria. In some examples, the game outcome may be calculated according to an outcome generated by each of the one or more randomizer units revealed after a spin. One or more rules may determine which wagers are winning wagers based on the outcome of the randomizer unit(s).

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Figure 12:
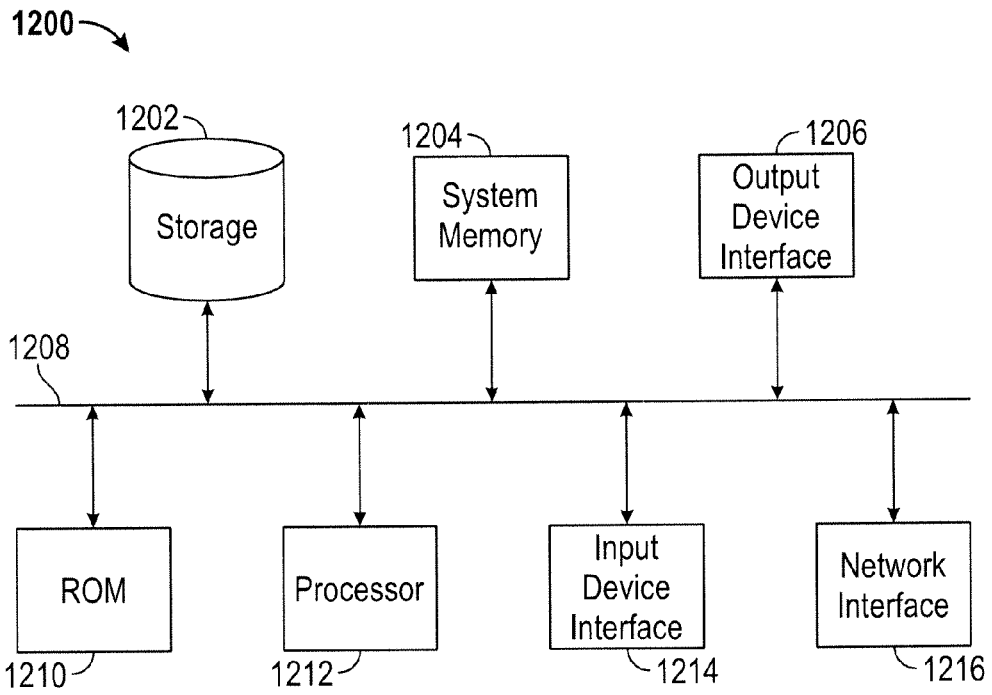
FIG. 12 conceptually illustrates an electronic system with which some implementations of the subject technology are implemented.

FIG. 12 conceptually illustrates an electronic system with which some implementations of the subject technology are implemented. Electronic system 1200 can be a server, computer, phone, PDA, laptop, tablet computer, television with one or more processors embedded therein or coupled thereto, or any other sort of electronic device. Such an electronic system includes various types of computer readable media and interfaces for various other types of computer readable media. Electronic system 1200 includes a bus 1208, processing unit(s) 1212, a system memory 1204, a read-only memory (ROM) 1210, a permanent storage device 1202, an input device interface 1214, an output device interface 1206, and a network interface 1216.

Bus 1208 collectively represents all system, peripheral, and chipset buses that communicatively connect the numerous internal devices of electronic system 1200. For instance, bus 1208 communicatively connects processing unit(s) 1212 with ROM 1210, system memory 1204, and permanent storage device 1202.

From these various memory units, processing unit(s) 1212 retrieves instructions to execute and data to process in order to execute the processes of the subject disclosure. The processing unit(s) can be a single processor or a multi-core processor in different implementations.

ROM 1210 stores static data and instructions that are needed by processing unit(s) 1212 and other modules of the electronic system. Permanent storage device 1202, on the other hand, is a read-and-write memory device. This device is a non-volatile memory unit that stores instructions and data even when electronic system 1200 is off. Some implementations of the subject disclosure use a mass-storage device (such as a magnetic or optical disk and its corresponding disk drive) as permanent storage device 1202.

Other implementations use a removable storage device (such as a floppy disk, flash drive, and its corresponding disk drive) as permanent storage device 1202. Like permanent storage device 1202, system memory 1204 is a read-and-write memory device. However, unlike storage device 1202, system memory 1204 is a volatile read-and-write memory, such a random access memory. System memory 1204 stores some of the instructions and data that the processor needs at runtime. In some implementations, the processes of the subject disclosure are stored in system memory 1204, permanent storage device 1202, and/or ROM 1210. For example, the various memory units include instructions for facilitating simulating of game play according to various embodiments. From these various memory units, processing unit(s) 1212 retrieves instructions to execute and data to process in order to execute the processes of some implementations.

Bus 1208 also connects to input and output device interfaces 1214 and 1206. Input device interface 1214 enables the player to communicate information and select commands to the electronic system. Input devices used with input device interface 1214 include, for example, alphanumeric keyboards and pointing devices (also called "cursor control devices"). Output device interfaces 1206 enables, for example, the display of images generated by the electronic system 1200. Output devices used with output device interface 1206 include, for example, printers and display devices, such as cathode ray tubes (CRT) or liquid crystal displays (LCD). Some implementations include devices such as a touchscreen that functions as both input and output devices.

Finally, as shown in FIG. 12, bus 1208 also couples electronic system 1200 to a network (not shown) through a network interface 1216. In this manner, the computer can be a part of a network of computers (such as a local area network ("LAN"), a wide area network ("WAN"), or an Intranet, or a network of networks, such as the Internet. Any or all components of electronic system 1200 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a player, implementations of the subject matter described in this specification can be implemented on a computer having a display device, e.g., a CRT (cathode ray tube) or LCD (liquid crystal display) monitor, for displaying information to the player and a keyboard and a pointing device, e.g., a mouse or a trackball, by which the player can provide input to the computer. Other kinds of devices can be used to provide for interaction with a player as well; for example, feedback provided to the player can be any form of sensory feedback, e.g., visual feedback, auditory feedback, or tactile feedback; and input from the player can be received in any form, including acoustic, speech, or tactile input. In addition, a computer can interact with a player by sending documents to and receiving documents from a device that is used by the player; for example, by sending web pages to a web browser on a player's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical player interface or a Web browser through which a player can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a player interacting with the client device). Data generated at the client device (e.g., a result of the player interaction) can be received from the client device at the server.

It is understood that one or more components of the systems and apparatuses disclosed is an illustration of exemplary embodiments. Based upon design preferences, it is understood that one or more components, elements, units or modules in the system and apparatuses may be removed, replaced or modified. One or more components, elements, unit or modules may be combined into a single element or a single component, element unit or module may be implemented using multiple components, elements, units or modules.

It is understood that any specific order or hierarchy of steps in the processes disclosed is an illustration of exemplary approaches. Based upon design preferences, it is understood that the specific order or hierarchy of steps in the processes may be rearranged, or that some illustrated steps may not be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software or hardware product or packaged into multiple software or hardware products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A system for simulating an outcome of a game, the system comprising:

one or more die, each die having a plurality of faces, each being associated with an index value;

a wheel having a surface for rolling of the one or more die, the surface of the wheel comprising a plurality of compartments, each compartment providing a pocket within the wheel for containing a respective die and configured such that a respective index value of the respective die may be read from underneath the wheel;

a randomization mechanism coupled to the wheel and configured to cause a randomized motion of the wheel and one or more die for a period of time to generate an outcome of game play, the outcome of game play being defined at least in part based on the index value of an exposed face of the plurality of faces after the completion of the randomized motion;

a cover configured to couple to the wheel to form a housing for encasing the surface of the wheel and the one or more die; and an outer cover configured to hide the cover, such that the one or more die and the surface of the wheel are not viewable at least for a portion of game play.

2. The system of claim 1, wherein each compartment is defined by a unique visual characteristic and defining an element.

3. The system of claim 2, wherein each of the die lands in one of the plurality of compartments of the wheel after the completion of the randomized motion.

4. The system of claim 3, wherein the outcome of the game is defined at least in part based on the element of the compartment in which the each of the die lands after the completion of the randomization movement.

5. The system of claim 4, wherein each of the elements represents a suit of playing cards.

6. The system of claim 1, wherein the portion of game play begins by initiation of the randomization mechanism and ends when the movement is completed.

7. The system of claim 1, wherein the cover is made of material having an ability to hide the one or more die and the surface of the wheel at least for a portion of game play.

8. The system of claim 1, wherein each of the plurality of faces is marked with a different playing card rank.

9. The system of claim 1, wherein each of the die is a dodecahedron marked with one or more of ranks selected from the group consisting of Ace, 1, 2, 3, 4, 5, 6, 7, 8, 9, or one or more face cards displaying a unique visual characteristic selected from the group consisting of one or more colors, characters, symbols or images.

10. The system of claim 9, wherein the one or more colors, characters, symbols or images comprise Jack, Queen, King, Chinese god elements, zodiac signs or symbols, sports symbols, cultural icons, or Chinese characters.

11. The system of claim 1, wherein the randomization mechanism is selected from the group comprising spinning mechanisms, rotation mechanisms, and vibration mechanisms.

12. The system of claim 1, further comprising a brake manually activated by a player to terminate operation of the randomization mechanism, wherein the random movement stops.

13. A system for simulating an outcome of a game having one or more die, each of the one or more die having a plurality of faces, each face being associated with an index value, the system comprising:

a wheel having a surface for rolling of one or more die, the surface of the wheel comprising a plurality of compartments, each compartment providing a pocket within the wheel for containing a respective die and configured such that a respective index value of the respective die may be read from underneath the wheel;

a randomization mechanism coupled to the wheel and configured to cause a randomized motion of the wheel and die for a period of time to generate an outcome of game play, the outcome of game play being defined at least in part based on the index value of an exposed face of the plurality of faces of each of the one or more die after the completion of the randomized motion;

a cover configured to couple to the wheel to form a housing for encasing the surface of the wheel and the one or more die; and an outer cover configured to hide the cover, such that the one or more die and the surface of the wheel are not viewable at least for a portion of game play.

14. A system for simulating game play, the system comprising:

an outcome simulation component for simulating an outcome of game play, the simulation component comprising one or more randomizer units that includes at least one die having a plurality of faces, each face of the at least one die being associated with an index value, each randomizer unit comprising:

a wheel having a surface for rolling of the at least one die, the surface of the wheel comprising a plurality of compartments, each compartment providing a pocket within the wheel for containing a respective die and configured such that a respective index value of the respective die may be read from underneath the wheel; and a randomization mechanism coupled to the wheel and configured to cause a randomized motion of the wheel and die for a period of time to generate an outcome of game play, the outcome of game play being defined at least in part based on the index value of an exposed face of the plurality of faces of the at least one die after the completion of the randomized motion;

a cover configured to couple to the wheel to form a housing for encasing the surface of the wheel and the at least one die; and an outer cover configured to hide the cover, such that the at least one die and the surface of the wheel are not viewable at least for a portion of game play.

15. The system of claim 14, wherein the one or more randomizer units of the outcome simulation component comprise a plurality of randomizer units divided into two or more sets of randomizer units, each set representing an outcome for one position in the game.

16. The system of claim 14, further comprising:

a wagering component for facilitating wagering on the outcome of game generated by the randomization mechanism.

* * * * *